United States Patent [19]

Würmli et al.

[11] 4,453,744

[45] Jun. 12, 1984

[54] PRESSURE-SENSITIVE OR HEAT-SENSITIVE RECORDING MATERIAL

[75] Inventors: Albert Würmli; Christel Tempel, both of Riehen, Switzerland

[73] Assignee: Ciba-Geigy Corporation, Ardsley, N.Y.

[21] Appl. No.: 385,595

[22] Filed: Jun. 7, 1982

[30] Foreign Application Priority Data

Jun. 15, 1981 [CH] Switzerland ..... 3930/81

[51] Int. Cl.[3] ..... B41M 5/16; B41M 5/18; B41M 5/22

[52] U.S. Cl. ..... 346/216

[58] Field of Search ..... 282/27.5; 427/150–153; 428/320.4–320.8, 488, 537, 913, 914, 411

[56] References Cited

U.S. PATENT DOCUMENTS

| | | | |
|---|---|---|---|
| 3,244,549 | 4/1966 | Farnham et al. | 282/27.5 |
| 3,244,550 | 4/1966 | Farnham et al. | 427/145 |
| 3,451,338 | 6/1969 | Baum | 282/27.5 |
| 3,834,929 | 9/1974 | Hayashi et al. | 282/27.5 |
| 3,937,864 | 2/1976 | Kohmura et al. | 428/411 |
| 4,312,522 | 1/1982 | Yamaguchi et al. | 282/27.5 |

*Primary Examiner*—Bruce H. Hess

*Attorney, Agent, or Firm*—Edward McC. Roberts

[57] ABSTRACT

A pressure-sensitive or heat-sensitive recording material which contains in its color reactant system, as developer for the color former, at least one metal-free compound of the formula

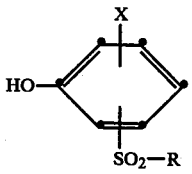

(1)

wherein R is alkyl of 1 to 12 carbon atoms, cycloalkyl, phenyl, benzyl, or phenyl which is substituted by halogen, nitro, methyl, methoxy, ethoxy or methylenedioxy, and X is hydrogen, halogen, carboxyl, lower alkyl or lower alkoxy.

12 Claims, No Drawings

PRESSURE-SENSITIVE OR HEAT-SENSITIVE RECORDING MATERIAL

The present invention relates to a pressure-sensitive or heat-sensitive recording material which contains in its colour reactant system, as developer for the colour former, at least one metal-free compound of the formula

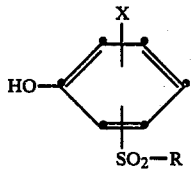

(1)

wherein R is alkyl of 1 to 12, preferably 1 to 4, carbon atoms, cycloalkyl, phenyl, benzyl, or phenyl which is substituted by halogen, methyl, methoxy, ethoxy, nitro or methylenedioxy, and X is hydrogen, halogen, carboxyl, lower alkyl or lower alkoxy.

X is preferably halogen, methyl, methoxy, ethoxy, carboxyl, but is most preferably hydrogen.

The R-$SO_2$ group is preferably in the ortho-position, but most preferably in the para-position, to the hydroxyl group.

The term "lower" qualifying alkyl and alkoxy groups will normally be understood to denote groups which contain 1 to 5, preferably 1 to 3, carbon atoms. Examples of lower alkyl groups are methyl, ethyl, isopropyl, sec-butyl and tert-butyl, and examples of lower alkoxy groups are methoxy, ethoxy or isopropoxy.

R an an alkyl group may be straight chain or branched. Examples of such alkyl groups are methyl, ethyl, n-propyl, isopropyl, n-butyl, isobutyl, sec-butyl, hexyl, octyl, isooctyl, nonyl or dodecyl. R as cycloalkyl may be cyclopentyl or preferably cyclohexyl. Preferred substituents in the phenyl moiety of the radical R are methyl or methoxy. Halogen may be fluorine, bromine or preferably chlorine.

Preferred compounds of the formula (1) are those in which R is methylphenyl, methoxyphenyl or preferably phenyl, and X is hydrogen.

Typical representatives of the phenolsulfonyl compounds to be used in the practice of this invention are:

4-hydroxy-1-methylsulfonyl-benzene,
4-hydroxy-1-ethylsulfonyl-benzene,
4-hydroxy-1-cyclohexylsulfonyl-benzene
4-hydroxy-1-benzylsulfonyl-benzene,
2-hydroxydiphenylsulfone,
4-hydroxydiphenylsulfone,
4'-nitro-4-hydroxydiphenylsulfone,
2'-nitro-4-hydroxydiphenylsulfone,
4'-chloro-4-hydroxydiphenylsulfone,
4'-fluoro-4-hydroxydiphenylsulfone,
4'-methyl-4-hydroxydiphenylsulfone,
3',4'-dimethyl-4-hydroxydiphenylsulfone or
4'-methoxy-4-hydroxydiphenylsulfone.

The preferred colour developer is 4-hydroxydiphenylsulfone.

The compounds of formula (1) are known compounds, but they constitute a novel class of colour developers or electron acceptors for colour formers. They may be obtained e.g. by reacting a compound of the formula

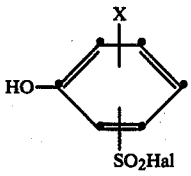

(2)

with a compound RH, or by reacting a compound of the formula $$R—SO_2—Hal \quad (3)$$

with a phenol of the formula

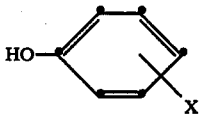

(4)

In the formulae (2), (3) and (4) above, X and R have the given meanings and Hal is halogen, e.g. chlorine, bromine or fluorine. The reaction is conducted in anhydrous medium in the presence of a Lewis acid, e.g. $AlCl_3$, $FeCl_3$, $ZnCl_2$, $SnCl_4$, $SbCl_5$ or $BF_3$, and conveniently in the temperature range from 50° to 200° C., preferably from 80° to 130° C. A further process comprises heating a compound of the formula

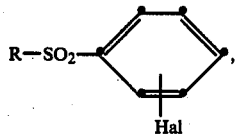

(5)

wherein R and Hal have the given meanings, with aqueous potassium hydroxide solution to 200°-220° C.

Compounds of the formula (1) and the preparation thereof are described e.g. in Beilstein, E II, 6, pp. 852-855, and E III, 6, pp. 4445-55.

The compounds of the formula (1) are almost colourless and odourless and are very reactive with the conventional colour formers, so that spontaneous, permanent and non-fading recordings or copies are obtained.

The colour formers suitable for the recording or copying material employed in this invention are known colourless or faintly coloured chromogenic substances which, when brought into contact with the compounds of the formula (1), become coloured or change colour. It is possible to use colour formers or mixtures thereof which belong e.g. to the classes of the azomethines, fluoranes, benzofluoranes, phthalides, spiropyranes, spirodipyranes, leucoauramines, triarylmethane leuco dyes, carbazolylmethanes, chromenoindoles, chromenopyrazoles, phenoxazines, phenothiazines as well as of the chromeno or chromano colour formers. Examples of such suitable colour formers are: crystal violet lactone (Registered Trade mark), 3,3-(bisaminophenyl)-phthalides, 3,3-(bis-substituted indolyl)-phthalides, 3-(aminophenyl)-3-indolylphthalides, 6-dialkylamino-2-n-octylaminofluoranes, 6-dialkylamino-2-arylaminofluoranes, 6-dialkylamino-3-methyl-2-arylaminofluoranes, 6-dialkylamino-2- or -3-lower alkylfluoranes, 6-dialkylamino-2-dibenzylaminofluoranes, 6-pyrrolidino-2-arylaminofluoranes, bis-(aminophenyl)-furyl-, -phenyl- or -carbazolylmethanes, 3'-phenyl-7-dialkylamino-2,2'-spirodibenzopyranes, bis-dialkylamino-benzhydrol-alkyl- or -arylsulfinates, benzoyldialkylaminophenothiazines or benzoyldialkylaminophenoxazines.

The compounds of the formula (1) are suitable for use as colour developers in a pressure-sensitive, or especially heat-sensitive, recording material, which can also be a copying material.

A pressure-sensitive material consists for example of at least one pair of sheets, which contain at least one colour former dissolved in an organic solvent, and a developer of the formula (1).

The developer is preferably applied in the form of a layer to the face of the receiver sheet.

The developers of the formula (1) may be used by themselves, in admixture with each other, or in admixture with known developers. Typical examples of such developers are activated clays such as attapulgite, acid clay, bentonite, montmorillonite, activated clay, e.g., acid-activated bentonite or montmorillonite, and also zeolith, halloysite, silica, alumina, aluminium sulfate, aluminium phosphate, zine chloride, zinc nitrate, kaolin or any clay or acidic organic compound, for example unsubstituted or ring-substituted phenols, salicylic acid or salicylates and their metal salts, or an acidic polymer, for example a phenolic polymer, an alkylphenolacetylene resin, a maleic acid/rosin resin or a partially or completely hydrolysed polymer of maleic acid and styrene, ethylene or vinyl methyl ether, or carboxypolymethylene.

The developers may also be used with other basically inert or almost inert pigments or further auxiliaries such as silica gel. Examples of such pigments are: talcum, titanium dioxide, zinc oxide, chalk, clays such as kaolin, as well as organic pigments, e.g. urea/formaldehyde or melamine/formaldehyde condensates.

The colour former effects a coloured marking at those points where it comes into contact with the developer. In order to prevent the colour formers contained in the pressure-sensitive recording material from becoming active prematurely, they are usually separated from the developer. This may conveniently be accomplished by incorporating the colour formers in foamlike, spongelike or honeycomb-like structures. Preferably the colour formers are enclosed in microcapsules, which as a rule can be ruptured by pressure.

When the capsules are ruptured by pressure, for example with a pencil, and the colour former solution is transferred in this manner to an adjacent sheet which is coated with the developer of formula (1), a coloured area is produced. This colour results from the dye which is formed and which is absorbed in the visible range of the electromagnetic spectrum.

The colour formers are encapsulated preferably in the form of solutions in organic solvents. Examples of suitable solvents are preferably non-volatile solvents, for example a polyhalogenated paraffin such as chloroparaffin, or a polyhalogenated diphenyl such as monochlorodiphenyl or trichlorodiphenyl, and also tricresyl phosphate or di-n-butyl phthalate; an aromatic ether such as benzylphenyl ether; a hydrocarbon oil such as paraffin or kerosene; an alkylated (e.g. with isopropyl or isobutyl) derivative of diphenyl, a diphenyl alkane, naphthalene or triphenyl, dibenzyl toluene, terphenyl, partially hydrogenated terphenyl, a benzylated xylene, or other chlorinated or hydrogenated, condensed aromatic hydrocarbons. Mixtures of different solvents are often used in order to obtain an optimum solubility for the colour formation, a rapid and intense coloration, and a viscosity which is advantageous for the microencapsulation.

The capsule walls can be formed evenly around the droplets of the colour former solution by coacervation; and the encapsulating material may consist of gelatin and gum arbabic, as described e.g. in U.S. Pat. No. 2,800,457. The capsules may also be formed preferably from an aminoplast or a modified aminoplast by polycondensation, as described in British patent specification Nos. 989,264, 1,156,725, 1,301,052 and 1,355,127. Also suitable are microcapsules which are formed by interfacial polymerisation, e.g. capsules formed from polyester, polycarbonate, polysulfonamide, polysulfonate, but in particular from polyamide or polyurethane.

The microcapsules containing the colour formers of the formula (1) may be used in combination with the developers for the production of a wide variety of known kinds of pressure-sensitive copying material. The various systems differ substantially from one another in the arrangement of the capsules, the colour reactants, i.e. the developers, and the support. A preferred arrangement is that in which the encapsulated colour former is in the form of a layer on the back of a transfer sheet and the developer is in the form of a layer on the face of a receiver sheet.

Another arrangement of the components is that wherein the microcapsules which contain the colour former, and the developer, are in or on the same sheet, in the form of one or more individual layers, or are present in the paper pulp.

The capsules are preferably secured to the support by means of a suitable adhesive. As paper is the preferred support, these adhesives are principally paper-coating agents, for example gum arabic, polyvinyl alcohol, hydroxymethyl cellulose, casein methyl cellulose, dextrin, starch or polymer latices. These latter are e.g. butadiene/styrene copolymers or acrylic homopolymers or copolymers.

The paper employed comprises not only normal paper made from cellulose fibres, but also paper in which the cellulose fibers are replaced (partially or completely) by synthetic polymers.

The compounds of the formula (1) are used in particular as developers in a thermoreactive recording material. This recording material usually contains at least one carrier, one colour former, one electron acceptor and optionally also a binder. Thermoreactive recording systems comprise, for example, heat-sensitive recording and copying materials and papers. These systems are used e.g. for recording information, for example in electronic computers, teleprinters or telewriters, or in recording and measuring instruments, e.g. electrocardiographs. The image (mark) formation can also be effected manually with a heated pen. Laser beams can also be used to produce heat-induced marks. The thermoreactive recording material can be composed such that the colour former is dispersed or dissolved in one binder layer and the developer is dissolved or dispersed in the binder in a second layer. Another possibility consists in dispersing both the colour former and the developer in one layer. By means of heat the binder is softened at specific areas and the colour former comes into contact with the developer at those points where heat is applied and the desired colour develops at once. The developers of formula (1) may also be used in heat-sensitive recording materials by themselves, as mixtures, or in admixture with known developers.

It is known to use for this purpose the same developers as are used in pressure-sensitive papers, as well as phenolic compounds, for example 4-tert-butylphenol, 4-phenyl- phenol, 4-hydroxydiphenyl ether, α-naphthol, β-naphthol, 4-hydroxymethylbenzoate, 4-hydroxyacetophenone, 2,2'-dihydroxydiphenyl, 4,4-isopropylidenediphenol, 4,4'-isopropylidene-bis(2-methylphenol), 4,4'-bis-(hydroxyphenyl)valeric acid, hydroquinone, pyrogallol, phloroglucinol, p-, m- and o-hydroxybenoic acid, gallic acid, 1-hydroxy-2-naphthoic acid, as well as boric acid and organic, preferably aliphatic, dicarboxylic acids, for example tartaric acid, oxalic acid, maleic acid, citric acid, citraconic acid and succinic acid.

It is preferred to use fusible, film-forming binders for the production of the thermoreactive recording material. These binders are normally water-suluble, whereas the colour formers and the developers are insoluble in water. The binder should be able to disperse and fix the colour former and the developer at room temperature.

By applying heat the binder softens or melts, so that the colour former comes in contact with the developer and a colour is able to form. Examples of binders which are soluble, or at least swellable, in water are hydrophilic polymers, such as polyvinyl alcohol, polyacrylic acid, hydroxyethyl cellulose, methyl cellulose, carboxymethyl cellulose, polyacrylamide, polyvinyl pyrrolidone, gelatin and starch.

If the colour former and the developer are in two separate layers, it is possible to use water-insoluble binders, i.e. binders which are soluble in non-polar or only weakly polar solvents, for example natural rubber, synthetic rubber, chlorinated rubber, alkyd resins, polystyrene, styrene/butadiene copolymers, polymethylacrylates, ethyl cellulose, nitrocellulose and polyvinyl carbazole. The preferred arrangement, however, is that in which the colour former and the developer are contained in one layer in a water-soluble binder.

The thermoreactive coatings may contain further ingredients. To improve the degree of whiteness, to facilitate the printing of papers, and to prevent the heated pen from sticking, the coatings may contain e.g. talcum, $TiO_2$, ZnO, $CaCO_3$ (e.g. chalk), clays, such as kaolin or also organic pigments, for example, urea/formadehyde polymers or melamine/formaldehyde polymers. In order to effect the colour formation only within a limited temperature range, there may be added substances such as urea, thiourea, diphenyl thiourea, acetamide, acetanilidine, stearyl amide, phthalic anhydride, metal chlorides, metal stearates, e.g. zinc stearate, phthalonitrile or other appropriate fusible products which induce the simultaneous melting of the colour former and the developer. Thermographic recording materials preferably contain waxes, e.g. carnabau wax, montan wax, paraffin wax or polyethylene wax.

The invention is illustrated by the following Examples, in which parts and percentages are by weight, unless otherwise indicated.

EXAMPLE 1

Two dispersions (A and B) are first prepared.

Dispersion A is prepared by grinding 5 g of 4-hydroxydiphenyl sulfone
20 g of a 10% aqueous solution of polyvinyl alcohol 25/140, and
10 g of water, over 2 to 4 hours with balls to a particle size of 2–4 μm.

Dispersion B is prepared by grinding 1 g of crystal violet lactone,
4 g of a 10% aqueous solution of polyvinyl alcohol 25/140, and
2 g of water, with balls to a particle size of 2–4 μm.

The two dispersions are then mixed.

The colourless mixture is applied with a doctor blade to paper having a weight of 50 g/m². The coating weight of the mixture is 3 g/m² (dry weight). The thermographic recording paper so obtained has a colourless surface and is stable at room temperature. A blue colour develops rapidly at 90° C., with saturation being reached at about 125° C.

EXAMPLE 2

Production of a heat-sensitive recording paper in accordance with the process described in Example 1, using the following dispersions C and D:

Dispersion C 8 g of 4-hydroxydiphenyl sulfone
3.3 g of kaolin
0.35 g of zinc stearate
0.35 g of paraffin wax
48.0 g of a 10% aqueous solution of polyvinyl alcohol and
24.0 g of water.

Dispersion D 1.0 g of crystal violet lactone
4.0 g of a 10% aqueous solution of polyvinyl alcohol and
2.0 g of water.

Coating weight: c. 4 g/m² (dry weight).

The base colour of the recording paper so obtained is neutral. A blue shade develops rapidly at 90° C., with saturation being reached at 125° C.

EXAMPLE 3

Heat-sensitive recording paper using the following dispersions E and F in accordance with the process described in Example 1.

Dispersion E 4 g of 4-hydroxydiphenyl sulfone
4 g of a urea/formaldehyde condensate (BET surface area 20 m²/g)
1 g of zinc chloride
36 g of a 10% aqueous solution of polyvinyl alcohol
18 g of water.

Dispersion F 1 g of crystal violet lactone
4 g of a 10% aqueous solution of polyvinyl alcohol
2 g of water.

Coating weight: c. 4 g/m² (dry weight).

The base colour of the recording paper so obtained is white. A blue colour develops rapidly at 90° C., with saturation being reached at 125° C.

EXAMPLE 4

The procedure of Example 1 is repeated, using 1 g of 2-phenylamino-3-methyl-6-diethylaminofluorane instead of crystal violet lactone for dispersion B.

The base colour of the recording paper so obtained is almost neutral. A black colour develops rapidly at 90° C., with saturation being reached at 125° C.

EXAMPLE 5

Heat-sensitive recording paper using the following dispersions G and H in accordance with the procedure described in Example 1.

Dispersion G
6.0 g of 4-hydroxydiphenyl sulfone
1.3 g of zinc stearate
31.8 g of a 4% aqueous solution of polyvinyl alcohol.
Dispersion H
0.8 g of silica gel
0.9 g of a urea/formaldehyde condensate (BET surface area 20 g/m$^2$)
1.0 g of 2-anilino-3-methyl-6-N-cyclohexyl-N-methylaminofluorane
16.0 g of a 4% aqueous solution of polyvinyl alcohol.

The base colour of the recording paper so obtained is neutral. A black colour develops rapidly at 90° C., with saturation being reached at 125° C.

EXAMPLE 6

Heat-sensitive recording paper using a dispersion K which is prepared in accordance with the procedure described in Example 1.
Dispersion K
4 g of 4-hydroxydiphenyl sulfone
1 g of crystal violet lactone
1 g of a urea/formaldehyde condensate (BET surface area 20 g/m$^2$)
24 g of a 10% aqueous solution of polyvinyl alcohol
10 g of water.

The base colour of the recording paper so obtained is almost neutral.

A blue colour develops rapidly at 90° C., with saturation being reached at 125° C.

EXAMPLE 7

A solution of 3 g of crystal violet lactone in 97 g of partially hydrogenated terphenyl is emulsified in a solution of 12 g of pigskin gelatin in 88 g of water of 50° C. A solution of 12 g of gum arabic in 88 g of water of 50° C. is then added, followed by the addition of 200 ml of water of 50° C. The resulting emulsion is poured into 600 g of ice-water and cooled, whereupon the concervation is effected. A sheet of paper is coated with the resultant suspension of microcapsules and dried. A second sheet of paper is coated with an aqueous dispersion P having a 35% solids content comprising
11 parts of 4-hydroxydiphenyl sulfone
75 parts of kaolin
25 parts of silica gel
8 parts of chalk
7 parts of a styrene/butadiene copolymer and
11 parts of starch.
Coating weight: 6 g/m$^2$ on paper having a basis weight of 48 g/m$^2$.

The first sheet and the sheet of paper coated with 4-hydroxydiphenylsulfone are laid on top of each other with the coated sides face to face. Pressure is exerted on the first sheet by writing by hand or typewriter and an intense blue copy develops on the sheet coated with the developer.

Instead of dispersion P it is also possible to use in this Example an aqueous dispersion Q consisting of
25 parts of 4-hydroxydiphenyl sulfone
110 parts of kaolin
40 parts of a urea/formaldehyde condensate (BET surface area 20 g/m$^2$)
20 parts of titanium dioxide
20 parts of chalk
35 parts of styrene/butadiene copolymer (50%) and
300 parts of water.
Coating weight: 5.5 g/m$^2$ on paper having a basis weight of 52 g/m$^2$.

EXAMPLE 8

Heat-sensitive recording paper using the following dispersions R and S prepared in accordance with the procedure described in Example 1.
Dispersion R
8 g of 2-hydroxydiphenyl sulfone
1 g of $ZnCl_2$
27 g of a 10% aqueous solution of polyvinyl alcohol
18 g of water.
Dispersion S
1 g of crystal violet lactone
3 g of a 10% aqueous solution of polyvinyl alcohol
2 g of water.
Coating weight: c. 3.5 g/m$^2$ (dry weight).

The base colour of the recording paper so obtained is white. A blue colour develops rapidly at 110° C., with saturation being reached at 150° C.

EXAMPLE 9

The procedure of Example 8 is repeated, using 4-hydroxy-4'-methyldiphenylsulfone instead of 2-hydroxydiphenyl sulfone.
Coating weight: c. 3.5 g/m$^2$ (dry weight).

The base colour of the recording paper so obtained is neutral. A blue colour develops rapidly at 110° C., with saturation being reached at 150° C.

EXAMPLE 10

Heat-sensitive recording paper using the following two dispersions T and U in accordance with the procedure described in Example 1.
Dispersion T
6 g of 4-hydroxy-4'-chlorodiphenyl sulfone
3 g of china clay
0.3 g of zinc stearate
0.3 g of paraffin wax
27 g of a 10% aqueous solution of polyvinyl alcohol
20 g of water.
Dispersion U
1 g of crystal violet lactone
3 g of a 10% aqueous solution of polyvinyl alcohol
2 g of water.
Coating weight: c. 3.6 g/m$^2$ (dry weight).

The base colour of the recording paper so obtained is white. A blue colour develops at 175° C. with saturation being reached at 225° C.

EXAMPLE 11

The procedure of Example 10 is repeated, using 4-hydroxyphenylmethyl sulfone instead of 4-hydroxy-4'-chlorodiphenyl sulfone. The base colour of the recording paper so obtained is neutral. A blue colour develops at 100° C., with saturation being reached at 150° C.

EXAMPLE 12

Heat-sensitive recording paper using 4-hydroxydiphenyl sulfone in combination with known colour formers.
Dispersion V
2 g of bisphenol A
6 g of 4-hydroxydiphenyl sulfone
2 g of a urea/formaldehyde condensate (BET surface area 20 g/m$^2$)
1 g of china clay 0.3 g of zinc stearate
40 g of a 10% aqueous solution of polyvinyl alcohol
25 g of water.

Dispersion W
1 g of crystal violet lactone
3 g of a 10% aqueous solution of polyvinyl alcohol
3 g of water.

Coating weight: c. 4 g/m$^2$ (dry weight).

The base colour of the recording paper so obtained is almost neutral. A blue colour develops at 80° C., with saturation being reached at 160° C.

What is claimed is:

1. A record material for use with a color former in pressure-sensitive or heat-sensitive copy systems, comprising a support having therein or thereon a metal-free color developer of the formula

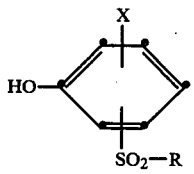

wherein R is alkyl of 1 to 12 carbon atoms, cycloalkyl, phenyl, benzyl, or phenyl which is substituted by halogen, nitro, methyl, methoxy, ethoxy or methylenedioxy, and X is hydrogen, halogen, carboxyl, lower alkyl or lower alkoxy.

2. The record material of claim 1, wherein X is hydrogen, halogen, carboxyl, methyl, methoxy or ethoxy.

3. The record material of claim 1, wherein R is phenyl, methylphenyl or methoxyphenyl, and X is hydrogen.

4. The record material of claim 3, wherein R is phenyl.

5. The record material of claim 4, wherein the color developer is 4-hydroxydiphenylsulfone.

6. A heat-sensitive record material of claim 1, which contains, in at least one layer, at least one color former, at least one color developer, and at least one binder.

7. The record material of claim 1, wherein the support further comprises the color former.

8. The record material of claim 7, wherein the support further comprises a binder.

9. The record material of claim 7, wherein the color former is dissolved in an organic solvent.

10. The record material of claim 9, wherein the color former solution is encapsulated in microcapsules.

11. The record material of claim 10, wherein the support comprises a transfer sheet having the microcapsules coated on the back thereof and a receiving sheet having the color developer on the face thereof.

12. The record material of claim 1, further comprising another color developer.

* * * * *